United States Patent [19]

Stewart

[11] Patent Number: 4,979,735

[45] Date of Patent: Dec. 25, 1990

[54] HYDRAULIC EXERCISE DEVICE WITH WORK MEASUREMENT

[76] Inventor: John V. Stewart, 1308 Henry Balch Dr., Orlando, Fla. 32810

[21] Appl. No.: 227,011

[22] Filed: Aug. 1, 1988

[51] Int. Cl.[5] ..... A63B 21/00

[52] U.S. Cl. ..... 272/130; 272/97; 272/73

[58] Field of Search ..... 272/130, 73, 97, 93, 272/DIG. 4, DIG. 5, DIG. 6, 69, 70, 142; 251/207, 209; 128/25 R, 25 B; 73/379

[56] References Cited

U.S. PATENT DOCUMENTS

| | | | |
|---|---|---|---|
| 2,449,833 | 9/1948 | Barnes | 251/209 |
| 2,504,007 | 4/1950 | Declerco | 272/73 |
| 3,081,634 | 3/1963 | Blaszkowski | 272/130 |
| 3,266,801 | 8/1966 | Johnson | 272/72 |
| 3,369,403 | 2/1968 | Carlin et al. | 272/130 |
| 4,235,437 | 11/1980 | Ruis et al. | 272/130 |
| 4,452,447 | 6/1984 | Lepley et al. | 272/130 |
| 4,579,335 | 4/1986 | Centafanti | 272/70 |
| 4,705,271 | 11/1987 | Mondloch et al. | 272/130 |

*Primary Examiner*—Stephen R. Crow

[57] ABSTRACT

A device is disclosed which provides a work load for exercise machines, and directly measures the work performed. It comprises a liquid pump, linked by a power transmission to an exercise mechanism, producing a flow rate proportional to the exertion rate. The output liquid volume is determined either by observing its level in a transparent container, or via a flow meter. Direct work measurement is assured by making the liquid flow itself the source of resistance for the exercise. This is done via measurement of the pumping force and calibration of the flow restrictions. Work load adjustment devices which maintain a constant ratio of work rate to flow rate are described.

3 Claims, 2 Drawing Sheets

HYDRAULIC EXERCISE DEVICE WITH WORK MEASUREMENT

BACKGROUND

1. Field of the Invention

Figure 1:
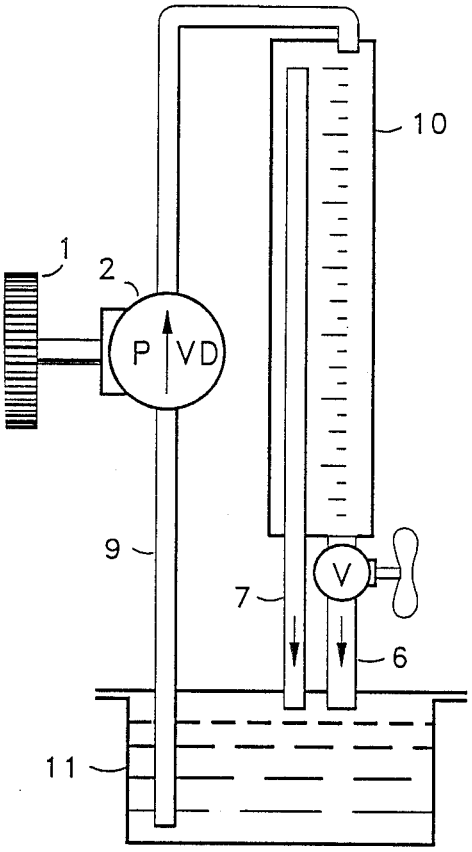

This invention relates to exercise machines, such as bicycling, rowing, and skiing simulators, and weight or elastic based lifting machines.

2. Prior Art

Exercise equipment takes many forms: free weights; rowing, skiing, and bicycling simulators; weight and elastic tension based machines. Each provides a work load and some means to judge the amount of work performed.

Free weights are effective for non-aerobic exercise. A measure of the work performed in a given weight-training program can be derived from the number of lift repetitions at each weight. However, a lifter's form and limb length determine the amount of work done in each repetition, so different lifters can expend different amounts of energy on identical programs. The form of a lifter can vary over time. These unknown variables make work measurement both inaccurate and inconsistent.

A major disadvantage of free weights is safety. If a grip slips, the weights drop, creating a hazard. Some weight stands can topple if the weights are set down carelessly, which is likely when exhaustion is reached. Another hazard occurs if a lift cannot be completed. Assistance is then needed or the weights must be thrown aside. These conditions can result in serious injury. Changing weights is inconvenient, especially when two lifters of different strengths alternately use the same bar. The inherent weight of any weight-based-equipment is a disadvantage in shipping and moving. Weights are noisy—a major disadvantage in multi-story buildings and dense residential installations.

Some of these disadvantages are absent in machines that work with elastic tension. However, work measurement is similarly inaccurate. Safety is better, but the mechanism can recoil if the grip slips, causing injury.

Equipment using resistance from friction or pneumatics, such as bicycling, skiing, and rowing simulators, have poor ability to measure work. Measurement of speed and miles 'traveled' is sometimes offered, but not the most significant quantity—work performed. A work calculation requires knowledge of the power input or resistance overcome, but these quantities are not measured.

Theoretically, one does not need to know the amount of work accomplished in a given exercise session. But when an effort cannot be measured, it becomes much less meaningful for most people, and harder to motivate. A known goal, and a way to measure progress, are basic components of motivation. This is enhanced if progress can be graphically displayed continuously during the effort.

OBJECTS AND ADVANTAGES

The object of this invention is to provide accurate, consistent measurement of the amount of exercise work performed on exercise equipment, so that the user can design measurable programs, track progress and maintain motivation. Another object is to provide a work load which can be directly quantified in work terms such as foot pounds, and is effective, safe, convenient, and practical.

This invention provides such a means of measuring exercise, and providing a measurable work load. It is safe, quiet, convenient, and light weight. There are no noisy weights, hazards from falling weights, or elastic recoil. Progress is measured continuously, integrated over time, and displayed graphically, in a natural format—no calculations required. Variability in the users' form and limb length are reflected in the measurement, enabling accuracy and consistency.

This invention can be employed in a wide variety of aerobic and non-aerobic exercise machines, including bicycling, rowing, skiing, and weight-lifting simulators. The mechanism is inherently simple, using basic physical principles, enabling practical manufacture and calibration.

DRAWING FIGURES

FIG. 1 is a stylized sectional view of the output-container embodiment

Figure 2:
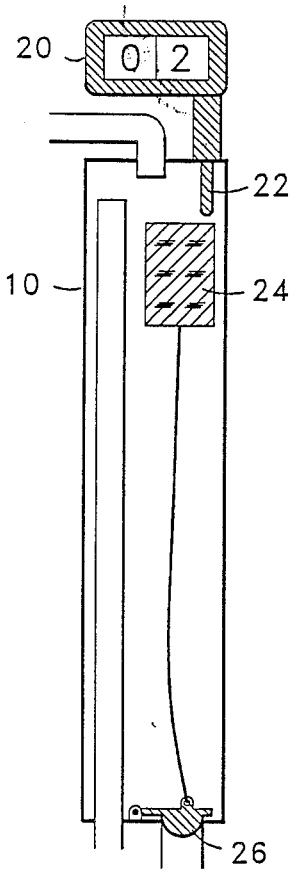
Figure 3:
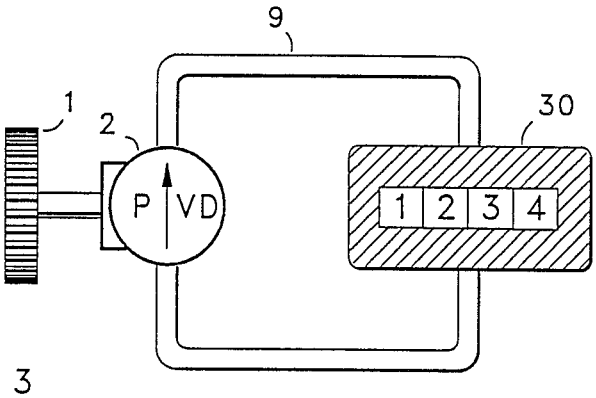
Figure 4:
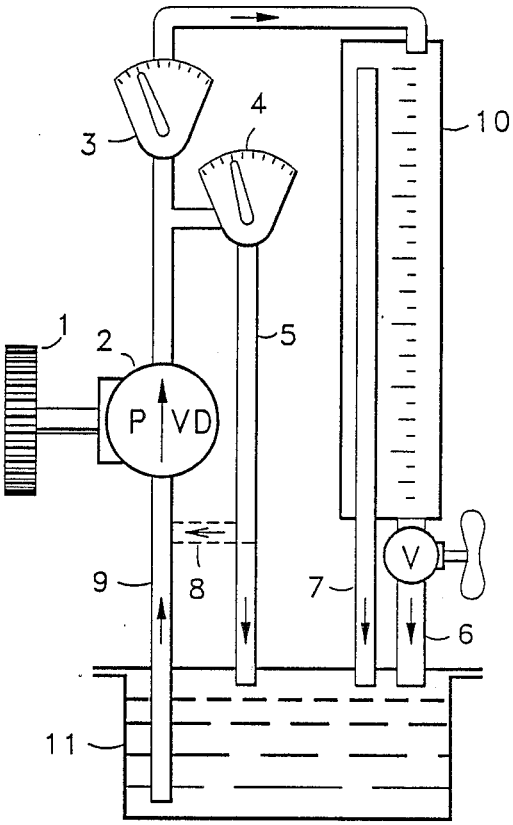
Figure 5:
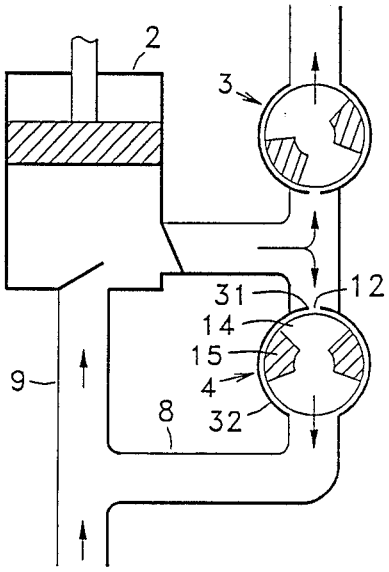
Figure 6:
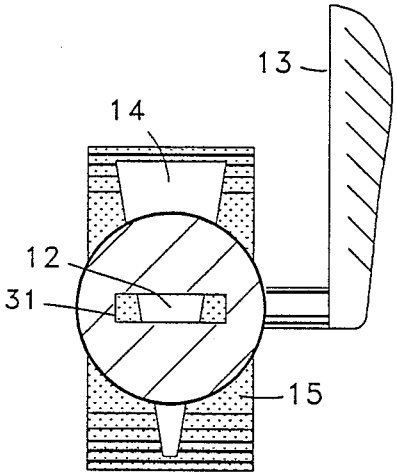

FIG. 2 shows an output container enhanced with a flush valve and cycle counter FIG. 3 is a schematic view of the flow meter embodiment FIG. 4 shows the FIG. 1 embodiment, enhanced with a load-adjustment circuit FIG. 5 is a stylized sectional view of a load-adjustment circuit with bypass FIG. 6 is a partial exploded view of a variable-aperture valve, showing rotor 15 and fixed aperture 12, as seen from the valve inlet

DRAWING REFERENCE NUMERALS

1 Transmission element
2 Liquid pump, variable delivery
3 Output flow restriction valve
4 Bypass flow restriction valve
5 Bypass flow path
6 Liquid return, or initialization, path
7 Overflow path
8 Optional bypass path
9 Liquid path
10 Output container
11 Reservoir
12 Effective aperture of load adjustment valve
13 Control lever of load adjustment valve
14 Rotatable aperture of load adjustment valve
15 Rotor of load adjustment valve
20 Counting device
22 Counter button
24 Float
26 Automatic return valve
30 Flow meter
31 Fixed aperture of load adjustment valve
32 Case of load adjustment valve

DESCRIPTION

A liquid pump is mechanically linked to an exercise mechanism via a power transmission. The transmission can be a simple friction wheel on the pump shaft, contacting a flywheel driven by the exercise mechanism. Flywheels are appropriate in aerobic exercise machines, especially bicycling simulators. Other practical transmission means include chain and sprocket, rack and pinion, and drive shafts. In most embodiments, the transmission should convert rectilinear to rotational motion if rotational motion is not otherwise available in the exercise mechanism. Transmissions such as cranks, with "dead center" positions, should not be used for this purpose. The circular motion can alternate directions if the pump operates in both directions. Reversing rotation can be used on a ski simulator, for instance, via rack and pinion. Some ski simulators include a flywheel, from which rotary power can be drawn.

All exercise machines offer resistance, which is usually adjustable. Resistance can be generated by the present invention, from fluid pumping, combined with appropriate flow restrictions, providing a direct relationship between the exercise rate and the liquid flow. Positive displacement pumps are generally most appropriate to provide this result.

In muscle-building or toning machines which are non-aerobic, a flywheel is not used. Resistance is needed in only one direction of effort. In the return direction, resistance can be either neutral, similar to, or opposite from, that of the primary direction. Neutral return resistance is suggested, where the exercise mechanism will return to its starting position without substantial force, but will not fall or recoil back. Spring tension and/or friction can be used to prevent fall-back of the mechanism due to gravity. Neutral return resistance offers safety. The machine will not recoil and strike the user, a spotter is not needed, and the user can stop instantly if a muscle begins to fail. The transmission can include a unidirectional engagement means, so that only the primary motion is transmitted to the pump.

An option is to transmit exercise motions to the push rod of a piston pump without conversion to circular motion. Each push of the exercise results in one push of the piston. The return motion merely recharges the cylinder. In this embodiment, the pump must be very sturdy to withstand the leveraged force of a powerful individual and resist that force in only one piston stroke. The pump output aperture must be very small relative to the pistion area, and the piston range should be long, allowing for long-limbed users.

A simple way to adjust resistance in this invention is via a valve which restricts the liquid flow. A series of apertures of various fixed sizes, each calibrated for a given work load, can be provided in a multi-position resistance valve. This valve should be designed such that the liquid output volume represents the same work units at all work-load settings. See FIGS. 4–6 for a suggested valve configuration.

As seen in FIG. 1, an exercise-driven pump 2 transfers a liquid from a reservoir 11 to an output container 10. All liquid must be returned to the reservoir when the output container fills, and before exercise begins. This can be done either by a manually operated valve, or by automatic means. The output container can be designed to flush automatically when full, via a float actuated return valve.

The range of design is great for the shape and size of the liquid containers, pump rate per power input, type of pump, and transmission. A simple approach is to provide a tall enough output container, and/or a slow enough pump rate, so that the container is unlikely to overflow during the maximum exercise session. However, it is desirable that the output container fill to about $\frac{3}{4}$ during the average session, since this is reasonably encouraging for the average user. The maximum session will then fill the container more than once. To keep track of these cycles, a counter is useful. It can be operated by a float, and reset manually.

FIG. 1 shows the relationship of components in a generalized basic embodiment. Item 1 shows a gear on the pump shaft. This represents the last element of power transmission in general. It can be a spur gear, pinion, friction wheel, sprocket wheel, or pulley. The pump can be located near the power source, to simplify transmission design, by routing the liquid path 9 as required. Any remaining distance is spanned by means such as a drive shaft, chain, belt, rack, gears, torsion cable, lever, and the like, depending on the transmission type. The pump shaft or drive shaft can have universal joint(s).

A piston force pump provides accurate metering and firm resistance, and is a suggested type of pump. Pump cycling should be essentially undetectable. A dual cylinder pump is preferred. If used only for metering, any type of variable delivery pump, which maintains a constant proportion of pump operating rate to liquid transfer rate over the expected range of operating speeds, can be used.

FIG. 2 details the output container 10, as enhanced with an automatic return valve and cycle counter. Float 24 can be guided by a vertical rod, not shown. When the container is full, counter button 22 is pressed, and return valve 26 is raised. The counter button should have an initial detent point which resists motion until float pressure has accumulated enough force to raise the return valve. The button should have a range of motion that allows the return valve to be raised after the detent point is passed. This enhancement allows the output container to be sized for the average user, rather than the maximum user.

A further enhancement is to provide the cycle counter 20 with electric current switching means. It can then signal an electronic device to produce audio announcements at given progress levels. This can be a simple tone when the counter is incremented, or it can be a recorded verbal message. Humorous progress reports can be issued, appropriate to the cycle number reached. For example, "You have just lifted a 200 lb. wrestler over your head—1500 foot pounds of work", and the like.

FIG. 3 is an alternate version of the basic device, in which work measurement is performed by a flow meter 30 instead of the previously shown transparent calibrated container 10 and related devices. A flow meter can also be used in embodiments in which work resistance is supplied by the invention, such as depicted in FIGS. 4–6.

FIG. 4 shows the addition of work load adjustment valves 3 and 4, for embodiments in which work resistance is supplied by the invention. These valves provide two types of adjustment of pumping flow resistance. Bypass valve 4 can be designed to provide a range of work loads without changing the ratio of work rate to flow rate. Increasing the bypass resistance increases both the work load and the proportion of output liquid. Output valve 3 is only needed where load adjustments must cover a very wide range, or for calibration purposes. Otherwise, a fixed aperture can be used instead of a valve at 3. This valve effects an inverse relationship between work load and output flow, thus the work units represented by a given output volume can be changed with this valve. This is useful for changing the calibration. For example, a given user may prefer a faster or slower than average flow rate for a given work load. If the liquid output volume is interpreted in absolute work units, such a change in calibration must be taken into account in the interpretation. For each calibration setting using valve 3, a range of loads is available via valve 4. Thus, valves 3 and 4 can be considered as course and fine adjustments, respectively. However, valve 3 might be designed with a very narrow range, and used only for fine tuning the calibration.

FIG. 5 shows details of a pump and load adjustment valves. Output valve 3 and bypass valve 4 are shown in relationship to pump 2 and associated liquid paths. The size and shape of aperture 12 of each valve results from the juxtaposition of a fixed aperture and adjacent rotatable aperture. The rotatable aperture varies in width from one limit of rotation to the other. This is clarified in FIG. 6.

FIG. 6 shows parts of a restriction adjustment valve. The internal rotatable part is shown, with a rotatable aperture 14 of varying width. In the foreground is the fixed aperture which, in combination with the rotatable aperture, results in effective aperture 12. The geometry of the two aperture components should be designed to provide a wide range of flow restriction. Settings should be provided which are calibrated in the combined assembly to produce a range of known work loads and proportional output flow rates.

The internal depiction of load adjustment valves is from the viewpoint of the approaching liquid path in FIG. 6, and from the side in FIG. 5 along the axis of rotation.

PREFERRED EMBODIMENT

The preferred embodiment comprises a rotary-driven positive displacement pump, a liquid circuit with a flow meter as in FIG. 3, and an adjustable flow restriction circuit as in FIG. 5.

OPERATION

Liquid is pumped by exercise power from a reservoir to a transparent container which is located in view of the user. The pump rate is proportional to the power exerted, so the amount of exercise performed is directly quantified by the liquid output level. The user tracks his or her progress easily by viewing this level. In place of a transparent output container, a flow meter may be used to quantify and display the accumulated flow volume.

If the pump is the source of resistance in the exercise machine, the work load may be adjusted by two possible mechanisms, depending on the embodiment:

1. A liquid flow restriction means may be provided, either with continuously variable valves, or with valves containing series of calibrated apertures in a range of sizes. Valve adjustment may be guided by detents at a series of calibrated settings, which can be marked on a surface adjacent the valve control handle. A restriction level is chosen which provides the desired work load.

2. A variable transmission means may be provided, such that the ratio of exercise motion to pump rotations is variable.

If the output container fills during a given session, the resolution depends on the embodiment:

1. If automatic recycling is provided, liquid in the output container will recycle to its starting container. If a counter is provided, it will be incremented. An audio announcement may be activated, alerting the user via a tone or recorded message that a progress point has been reached.

2. If automatic recycling is not provided, the user manually recycles the liquid. Secondary output containers may back up the first container, deferring the need for recycling until the last container is filled.

3. If dual alternating containers are provided, the currently full container is not flushed. Instead, the direction of flow is switched, manually or automatically, a counter may be incremented, and a progress announcement activated.

4. In all embodiments an overflow means backs-up the other options, providing another return path to the input container.

At the end of a session, progress is measured by the final liquid level plus the counter value. If a flow meter is used, it indicates the output liquid volume numerically.

I claim:

1. In a physical exercise machine of the type in which physical exertion of a user produces mechanical motion in the machine, an improvement comprising:

first and second liquid-containment areas;

a first liquid-communication path between said first and second areas;

a liquid pump, including an inlet, an outlet, and a power input member which drives said pump;

said pump connected in said first communication path for the transfer of a liquid from said first to second areas;

means for transmission of said mechanical motion to the power input member of said pump;

means for measuring the volume of liquid transferred by said pump;

a second liquid-communication path between said areas for returning the liquid from the second to the first area;

means for automatic return of at least part of the liquid from the second to the first area when the liquid reaches a predetermined level in the second area, comprising a float-actuated flush valve in the second area; and means for adjustably restricting the pumped flow of said liquid, having a range of partial flow-restriction settings;

whereby operation of the exercise machine operates the pump, which creates an adjustable work load on the machine, and produces a liquid flow, the volume of which is measured, and is proportional to the work performed on the machine.

2. In a physical exercise machine of the type in which physical exertion of a user produces mechanical motion in the machine, an improvement comprising:

first and second liquid-containment areas;

a first liquid-communication path between said first and second areas;

a liquid pump, including an inlet, an outlet, and a power input member which drives said pump;

said pump connected in said first communication path for the transfer of a liquid from said first to second areas;

means for transmission of said mechanical motion to the power input member of said pump;

means for measuring the volume of liquid transferred by said pump;

recycling means, comprising a valve and a second liquid communication path between said liquid containment areas, for returning said liquid from said second to said first area; and means for adjustably restricting the flow of said liquid, comprising first and second adjustable flow valves, a bypass liquid path connected to said first liquid communication path on both the inlet and outlet sides of said pump, said first adjustable flow valve being connected in the first liquid communication path on the outlet side of the pump between the connection of said bypass path and said second containment area, and said second adjustable flow valve being connected in the bypass path, so that liquid from the pump outlet can take two paths, one continuing toward the second containment area through the first flow valve, and the other returning to the pump inlet through the second flow valve via the bypass, the proportion of liquid taking each path being controllable by the two adjustable flow valves;

whereby operation of the exercise machine operates the pump, which creates an adjustable work load on the machine, and produces a liquid flow, the volume of which is measured, and is proportional to the work performed on the machine.

3. In a physical exercise machine of the type in which physical exertion of a user produces mechanical motion in the machine, an improvement comprising:

a liquid pump, including an inlet, an outlet, and a power input member which drives said pump;

a liquid-communication path connected between the inlet and outlet of said pump;

a liquid flow-volume meter connected in said liquid communication path;

means for transmission of said mechanical motion to the power input member of said pump; and means for adjustably restricting the flow of said liquid, comprising first and second adjustable flow valves, and a bypass liquid path connected to said liquid communication path on both the inlet and outlet sides of said pump, said first adjustable flow valve being connected in the liquid communication path on the outlet side of the pump between the connection of said bypass path and said liquid flow meter, and said second adjustable flow valve being connected in the bypass path, so that liquid from the pump outlet can take two paths, one continuing toward the flow meter through the first flow valve, and the other returning to the pump inlet through the second flow valve via the bypass, the proportion of liquid taking each path being controllable by the two adjustable flow valves;

whereby operation of the exercise machine operates the pump, which creates an adjustable work load on the machine, and produces a liquid flow, the volume of which is measured, and is proportional to the work performed on the machine.

* * * * *